US008942400B2

(12) United States Patent
Adamson et al.

(10) Patent No.: US 8,942,400 B2
(45) **Date of Patent: *Jan. 27, 2015**

(54) SUBCUTANEOUS PIEZOELECTRIC BONE CONDUCTION HEARING AID ACTUATOR AND SYSTEM

(75) Inventors: Robert Bruce Alexander Adamson, Halifax (CA); Jeremy A. Brown, Halifax (CA); Manohar Bance, Halifax (CA); Akhelish Kotiya, Halifax (CA)

(73) Assignee: Dalhousie University, Halifax (CA)

( * ) Notice: Subject to any disclaimer, the term of this patent is extended or adjusted under 35 U.S.C. 154(b) by 262 days.

This patent is subject to a terminal disclaimer.

(21) Appl. No.: 13/375,397

(22) PCT Filed: Jun. 8, 2010

(86) PCT No.: PCT/CA2010/000845

§ 371 (c)(1),
(2), (4) Date: Nov. 30, 2011

(87) PCT Pub. No.: WO2010/142018

PCT Pub. Date: Dec. 16, 2010

(65) Prior Publication Data

US 2012/0088957 A1 Apr. 12, 2012

Related U.S. Application Data

(60) Provisional application No. 61/185,309, filed on Jun. 9, 2009.

(51) Int. Cl.
*H04R 25/00* (2006.01)

(52) U.S. Cl.
CPC ..... *H04R 25/606* (2013.01); *H04R 2460/13* (2013.01)
USPC ..... 381/326; 381/151; 381/190

(58) Field of Classification Search
USPC ..... 381/312, 315, 326, 328, 380, 190, 151; 600/25; 607/55, 56, 57
See application file for complete search history.

(56) References Cited

U.S. PATENT DOCUMENTS 3,764,748 A * 10/1973 Branch et al. ..... 607/57
8,170,252 B2 * 5/2012 Parker et al. ..... 381/326

(Continued)

FOREIGN PATENT DOCUMENTS

EP 1542499 A2 6/2005
WO WO 03/042133 A1 5/2003

(Continued)

OTHER PUBLICATIONS

Chinese Office Action dated Sep. 4, 2013 and translation thereof, received in the corresponding Chinese application 201080025640.8.

(Continued)

*Primary Examiner* — Huyen D Le
(74) *Attorney, Agent, or Firm* — David Nauman; Borden Ladner Gervais LLP

(57) ABSTRACT

An implantable bone-conduction hearing actuator based on a piezoelectric element, such as a unimorph or bimorph cantilever bender, is described. Unlike other implantable bone conduction hearing actuators, the device is subcutaneous and once implanted is entirely invisible. The device excites bending in bone through a local bending moment rather than the application of a point force as with conventional bone-anchored hearing aids.

22 Claims, 5 Drawing Sheets

(56) References Cited

U.S. PATENT DOCUMENTS

| | | | | |
|---|---|---|---|---|
| 2007/0041595 | A1 | 2/2007 | Carazo et al. | |
| 2007/0156011 | A1 | 7/2007 | Westerkull | |
| 2007/0191673 | A1 | 8/2007 | Ball et al. | |
| 2009/0209806 | A1 | 8/2009 | Hakansson | |
| 2009/0248155 | A1* | 10/2009 | Parker | 623/10 |
| 2013/0261377 | A1* | 10/2013 | Adamson et al. | 600/25 |

FOREIGN PATENT DOCUMENTS

| | | | |
|---|---|---|---|
| WO | 2004052256 | A1 | 6/2004 |
| WO | 2009121099 | A1 | 10/2009 |

OTHER PUBLICATIONS

PCT Patent Application No. PCT/CA2010/000845, International Search Report dated Sep. 8, 2010.

Dong et al., "Analytical Solutions for the Transverse Deflection of a Piezoelectric Circular Axisymmetric Unimorph Actuator", IEE Transactions on Ultrasonics, Ferroelectrics and Frequency Control, vol. 51, No. 6, Jun. 2007, pp. 1240-1249.

Hakansson et al., "A novel bone conduction implant (BCI)—engineering aspects and preclinical studies", International Journal of Audiology, Mar. 2010, vol. 49., No. 3, pp. 1-16.

Australian Examination Report No. 1, dated Nov. 25, 2013, for corresponding Australian Patent Application No. 2010258035.

United States Office Action, dated Nov. 27, 2013, for corresponding United States Continuation-in-Part U.S. Appl. No. 13/908,580.

Office Action dated Mar. 27, 2014 for corresponding Chinese Patent Application No. 201080025640.8, along with English translation.

Extended European Search Report for European Application No. 11780027.6 dated Apr. 3, 2014.

H.P. Vasantha Rupasinghe et al: "Antioxidant Protection of Eicosapentaenoic Acid and Fish Oil Oxidation by Polyphenolic-Enriched Apple Skin Extract." Journal of Agricultural and Food Chemistry., vol. 58, pp. 1233-1239.

Chinnici F. et al: "Radical scavenging activities of peels and pulps from cv. golden delicious apples as related to their phenolic composition", Medicinal & Aromatic Plants Abstracts, Scientific Publishers, vol. 52, pp. 4684-4689.

Xiangjiu He et al: "Phytochemicals of Apple Peels: Isolation, Structure Elucidation, and Their Antiproliferative and Antioxidant Activities", J. Agr. and Food Chem, vol. 56, pp. 9905-9910.

Examination Report issued by European Patent Office on Apr. 22, 2014 for European Patent Application No. 10785616.3.

* cited by examiner

SUBCUTANEOUS PIEZOELECTRIC BONE CONDUCTION HEARING AID ACTUATOR AND SYSTEM

CROSS-REFERENCE TO RELATED APPLICATIONS

This application is a National Phase Entry of PCT/CA2010/000845 filed Jun. 8, 2010, which claims the benefit of priority of U.S. patent application Ser. No. 61/185,309, filed Jun. 9, 2009, the contents of which are incorporated by reference in their entirety.

FIELD OF TECHNOLOGY

The present invention relates to a subcutaneous actuator for exciting bone vibration. In particular, the present invention is directed to a subcutaneous piezoelectric actuator for exciting bone vibration for bone conduction hearing aid devices.

BACKGROUND

Bone conduction is a mechanism for delivering sound to the cochlea by sending vibrations through the skull rather than the eardrum and middle ear as in ordinary air conduction hearing. For patients with conductive hearing loss due to disease or trauma, hearing aids that employ bone conduction offer a promising way of restoring hearing. While hearing aids relying on bone conduction have existed for many years, it was only with the advent of the implantable bone anchored hearing aid (BAHA®) that a reliable, effective and commercially successful option became available. The existence of the BAHA has led to an expansion of the use of bone conduction to treat other hearing disorders. For example, bone conduction has recently been used for patients with single-sided deafness to route acoustic information on the deaf ear side to the hearing ear. For patients with moderate to severe conductive hearing loss, bone conduction technologies offer a promising alternative to traditional air-conduction hearing aids. Bone conduction represents an alternative route for sound to enter the cochlea in a way that completely bypasses the middle ear. As a result, even patients with completely devastated middle ears can benefit from bone conduction technologies.

Sound is transduced into neural impulses at the inner hair cells of the cochlea. Thus in order to achieve hearing, an actuator must have a means for moving these hair cells. In ordinary air-conducted hearing, pressure oscillations in air drive the motion of the tympanic membrane which is connected to the oval window of the cochlea through the middle ear ossicles. The stapes footplate pushes the oval window in and out, driving fluid through the cochlea. The resulting fluid pressure shears the basilar membrane to which the hair cells are attached, and their motion opens ion channels that trigger neural impulses.

When the skull vibrates, a variety of inertial and elastic effects transmit some fraction of those vibrations to the cochlear fluids and thence to the hair cells. While the detailed mechanics of the interaction between vibrations in the skull and the cochlear fluids is an area of active research, it is generally accepted that any motion of the bony cochlear promontory will result in some perception of sound. In designing bone-conduction based hearing aids one typically considers the vibratory level of promontory bone motion as a rough correlate for bone-conducted hearing level. Conversely, any device that can achieve significant motions of the promontory will be a promising candidate for a bone-conducted hearing device.

The BAHA® consists of two parts, a percutaneous titanium abutment that is screwed directly into the patient's mastoid where it osseointegrates in the bone, and an electromagnetic motor that drives a 5.5 g inertial mass, thereby generating a reactive force into the abutment. While popular and effective, the percutaneous nature of the BAHA® often leads to skin infections and patient discomfort, as well as presenting a cosmetic barrier to adoption. The abutment requires constant post-operative care, extensive skin thinning of subcutaneous tissues around it and the removal of hair follicles in its vicinity to function well. For low-frequency vibrations below approximately 1200 Hz, the high stiffness of the skull guarantees that the entire head moves as a rigid body. Consequently the BAHA® must drive the mass of the entire head in order to excite motion of the cochlear fluids in the cochlea. While effective, this whole-head motion requires considerable energy, and a consequent large drain on the battery powering the BAHA®.

A subcutaneous bone conduction implant (BCI) has been reported and validated on embalmed heads. This device relies on an improved version of the BAHA motor called the balanced electromagnetic separation transducer (BEST). The BEST-BCI works on essentially the same principle as the BAHA, relying on an inertial mass reactance to provide the vibratory power. While promising, the device dimensions are large and implantation requires a 15 mm×10 mm×10 mm hole to be made by resectioning of the mastoid. Many mastoids are too sclerotic to accommodate this and many candidate patients who would otherwise conform to indications for bone conduction implants have already undergone extensive mastoid surgery and do not possess intact mastoids suitable for implantation.

Other implantable hearing devices target different parts of the auditory system to treat conductive hearing loss. Middle ear implants such as the Vibrant Sound Bridge are available. While effective, these devices require an intact ossicular chain and the implantation procedure is time-consuming and delicate. More recently, middle-ear implants have been placed in the round window niche of the cochlea where they directly drive the round window membrane causing motion of perilymph. Although this approach is promising where the middle ear is not sufficiently intact for a middle ear implant, the surgery remains quite difficult and results to date have been mixed. Another kind of implantable hearing aid is the cochlear implant, but this is typically indicated only for sensorineural loss, not for conductive loss as its implantation often results in the destruction of residual hearing.

There is, therefore, a need for bone-conduction technologies that can provide vibratory stimulation to the cochlea without percutaneous abutments or invasive and delicate surgical procedures, and that are more efficient than current technologies.

SUMMARY

In a first aspect, a bone conduction hearing aid is provided. The hearing aid comprises a piezoelectric transducer for subcutaneous fixation to a skull of a patient in the vicinity of the mastoid promontory. The piezoelectric transducer is distorted in response to electrical impulses to deform bone of the skull in the vicinity the piezoelectric transducer, and to thereby apply a compressional lateral stress to the bone to generate bone vibration to excite the movement of cochlear fluids.

According to embodiments, the piezoelectric transducer can be configured to apply a localized bending moment to the skull.

Driver circuitry, which can for example include an inductive link, applies the electrical impulses to the piezoelectric transducer in response to sound waves detected by a microphone. The inductive link can comprise a transmitter coil for external placement and transcutaneous excitation of a complementary implanted receiver coil connected to the piezoelectric transducer, or the driver circuitry can be self-contained and configured for subcutaneous implantation.

According to specific embodiments, the piezoelectric bender can be a disk bender or a beam bender, and can be in the form of a unimorph, bimorph or multilayered piezoelectric bender, or any polyhedron shaped bender including at least one piezoelectric layer.

According to further embodiments, the piezoelectric transducer can be configured for fixation to an outer surface of the skull, such as by bonding to the outer surface of the skull. Such bonding can include application of a biocompatible adhesive, such as a cyanoacrylate adhesive, bone cement, bonding wax, epoxy, or glue. The subcutaneous fixation can also comprise fasteners for attaching the piezoelectric transducer to the skull, such as titanium screws. The piezoelectric transducer can also be configured for fixation in a slot formed in the skull. Such an embodiment is particularly appropriate for stack or tube piezoelectric transducers. The piezoelectric transducer can also include means to promote osseointegration.

According to a further aspect, an actuator for a bone conduction hearing aid system is provided. The actuator comprises at least one piezoelectric bender for subcutaneous fixation to a skull of a patient in the vicinity of the mastoid promontory. The piezoelectric bender is distorted in response to an electric field to deform bone of the skull in the vicinity the piezoelectric bender, and to thereby apply a compressional lateral stress to the bone to generate bone vibration to excite the movement of cochlear fluids.

According to specific embodiments, the piezoelectric bender can be a disk bender or a beam bender, or can have any polyhedron shape. Such a bender can be, for example, a unimorph, bimorph or multilayered bending piezoelectric transducer, and can include means to promote osseointegration.

BRIEF DESCRIPTION OF THE DRAWINGS

Embodiments of the present disclosure will now be described, by way of example only, with reference to the attached Figures, wherein.

DETAILED DESCRIPTION

The present invention provides a subcutaneous piezoelectric actuator as a means for creating bone-conduction hearing. In contrast to inertial mass transducers like the BAHA, the present device elastically deforms the skull in order to generate localized bending in the bone, thereby creating vibrations in the bone which can be detected by the cochlea. As a result the device can be of very low mass and thickness and is suitable for subcutaneous implantation. Measurements conducted on embalmed human heads show that the device is capable of exciting the same level of motion at the bony cochlear promontory as the BAHA with comparable electrical power draw, and that up to ten times greater efficiency may be achievable with improvements in impedance matching electronics.

By directly bonding or fixing a piezoelectric actuator to the skull, bone-conducted hearing can be generated without requiring a bone-anchored abutment or an inertial motor. Because piezoelectric elements are small and thin they can lie entirely beneath the skin, receiving their electrical stimulation transcutaneously through, for example, a magnetic coil. The actuator relies on elastic deformation instead of inertial reactance to excite vibration of the cochlea. As a result, the device can be made entirely subcutaneous, solving both the hygienic and cosmetic issues with percutaneous bone anchored hearing aids. It is very simple to implant clinically, and could most likely be done under local anaesthetic. Measurements performed on cadaver heads show that the present actuator is capable of achieving significantly higher efficiencies than the BAHA once a broadband electrical matching system is developed.

The vibration mechanism for such an actuator is fundamentally different from that used by inertial devices. Instead of generating force by pushing off a counterweight like the BAHA, or off a fixed plate like the BCI, a piezoelectric actuator applies a bending moment to the skull in the vicinity of the actuator which causes an elastic deformation in the bone. At low frequencies this deformation will not propagate away from the excitation point meaning that the elastic energy can be strongly localized around the actuator. This makes piezoelectric actuators fundamentally more efficient than inertial actuators, particularly at lower frequencies, such as those in the range of human hearing.

Figure 1:
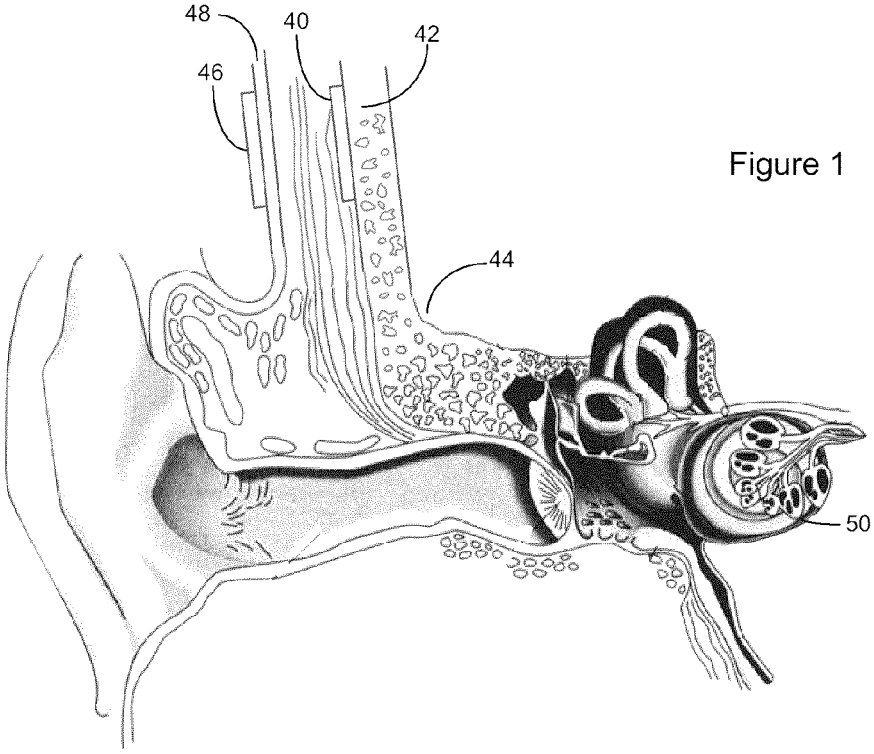
FIG. 1 is diagram of a hearing aid system according to the present invention.

FIG. 1 shows an embodiment of a hearing aid system according to the present invention. The auditory system and surrounding skull area are shown in cross-section. A piezoelectric actuator 40 is shown directly attached to the skull 42 subcutaneously in the vicinity of mastoid promontory 44. An exterior driving unit 46 is secured to the surface of the skin 48 covering the actuator 40. The exterior driving unit 46, which includes a microphone, in conjunction with conventional circuitry such as an amplifier and battery (not shown), receives sound waves and converts them into electrical impulses. According to an embodiment, a transcutaneous magnetic induction power delivery system similar to those used in powering cochlear implants can be used to actuate the actuator. As is well known, the electrical impulses can excite a transmitting coil at the surface of the skin. The implanted piezoelectric actuator 40 is then actuated by a complementary receiving coil (not shown) to apply vibrations to the skull 42, which are conducted to the cochlea 50.

Piezoelectric actuators provide a simple and efficient means of creating high forces and small strains as is required to generate bone vibration. These devices exploit the piezoelectric effect, a change in material crystal structure due to an applied electric field. They tend to have high mechanical source impedances, generating large forces and small strains, but this impedance can be reduced by using various "gearbox" geometries such as bending beams and piezoelectric stacks.

The configuration of the actuator 40 can vary greatly depending on design requirements. Piezoelectric disk, beam, stack and tube actuators can be used. Piezoelectric stack actuators are manufactured by stacking up piezoelectric disks or plates, the axis of the stack being the axis of linear motion when a voltage is applied. Tube actuators are monolithic devices that contract laterally and longitudinally when a voltage is applied between the inner and outer electrodes. A disk actuator is a device in the shape of a planar disk. Ring actuators are disk actuators with a center bore, making the actuator axis accessible for mechanical, or electrical purposes. Preferably, the actuator geometry and configuration is chosen such that a lateral compressional stress is applied to the bone of the skull to which the actuator is fixed, thereby generating a bending or deformation of the skull in the vicinity of the actuator.

Thin two-layer piezoelectric elements are a versatile configuration that can provide the necessary bending or torquing forces. Two-layer piezoelectric elements produce curvature when one layer expands while the other layer either contracts or remains static. Such actuators achieve large deflections relative to other piezoelectric transducers. Two-layer elements can be made to elongate, bend, or twist depending on the polarization, geometry and configuration of the layers. A unimorph has a single layer of piezoelectric material adhered to a metal shim, while a bimorph has two layers of piezoelectric material on either side of a metal shim. These transducers are often referred to as benders, or flexural elements, and the terms "bender", "bending actuator", "transducer" and "actuator" are used interchangeably herein. Bender motion on the order of hundreds to thousands of microns, and bender force from tens to hundreds of millinewtons, is typical. Particular configurations include disk and beam benders. As will be understood by the skilled worker, any other suitable configuration of benders can be used. That is, any suitably shaped polyhedron bender can be used. As will also be understood by the skilled worker, a bender can include any suitable number of piezoelectric layers.

Figure 2:
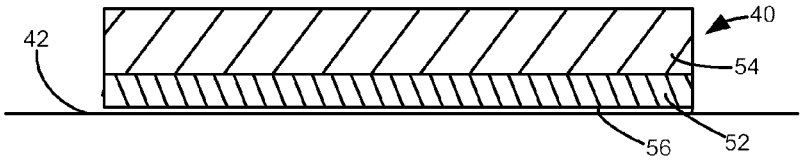
FIG. 2 is a cross section of a unimorph piezoelectric actuator according to the present invention.

FIG. 2 shows a cross section of a beam bending actuator 40 (not to scale) attached to the surface of the skull 42 according to an embodiment. The illustrated actuator 40 is a unimorph bender having a metal layer 52, such as a brass layer, and a piezoelectric layer 54. A thin layer of adhesive 56 attaches the actuator 40 to the skull 42. For bending actuators, such as disc or beam, unimorph or bimorph, actuators, fixation to the skull can be achieved with an adhesive such as cyanoacrylate adhesive, bone cement, bonding wax, epoxy, glue, osseointegrated titanium, calcium phosphate, hydroxyapatite or other means or with low profile titanium screws.". Though not shown, various means can be used to promote osseointegration of the actuator and the skull. Such means include, for example, a roughened adhesion surface, holes, ridges or titanium coating of surfaces contacting the skull.

Figure 3:
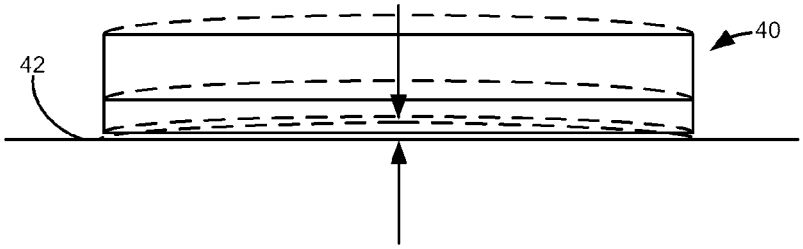
FIGS. 3 and 4 are cross sections of a unimorph piezoelectric actuator during bending.

As shown by the dashed lines in FIG. 3, when the bending actuator 40 flexes the ends will try to move closer together, imparting a localized, compressional stress to the bone 42. The amount of deformation, as indicated by the distance between the arrows 60, will depend on the size and geometry of the actuator 40, and the power applied to it. For disc benders the stress will be radially symmetric, while for bending beam actuators it will be directed along the longitudinal axis of the bender. Other shapes can be used to achieve better directionality or to better fit the location of bonding.

For piezoelectric stack and tube actuators, a small slot can be drilled into the skull and the piezoelectric inserted into the slot, along with a filling element such as bone cement. Expansion of the piezoelectric then creates compressional lateral stress in the surrounding bone.

In operation, the present piezoelectric transducer produces a strongly localized vibration centered on the transducer, particularly at frequencies below approximately 1500 Hz, whereas the BAHA moves the entire head as a single rigid body. At higher frequencies this pattern begins to break up as higher vibratory modes of the skull begin to be excited. For speech comprehension, the spectral region below 2000 Hz is of primary importance. In this experimental measurements demonstrate that the present piezoelectric actuator produces localized strain in the skull, which is capable of generating bone-conducted hearing if the actuator is placed sufficiently close to the cochlear promontory, and that it can achieve higher transduction efficiency than the BAHA since it deforms the skull only around the placement site and does not need to vibrate the entire head.

Figure 4:
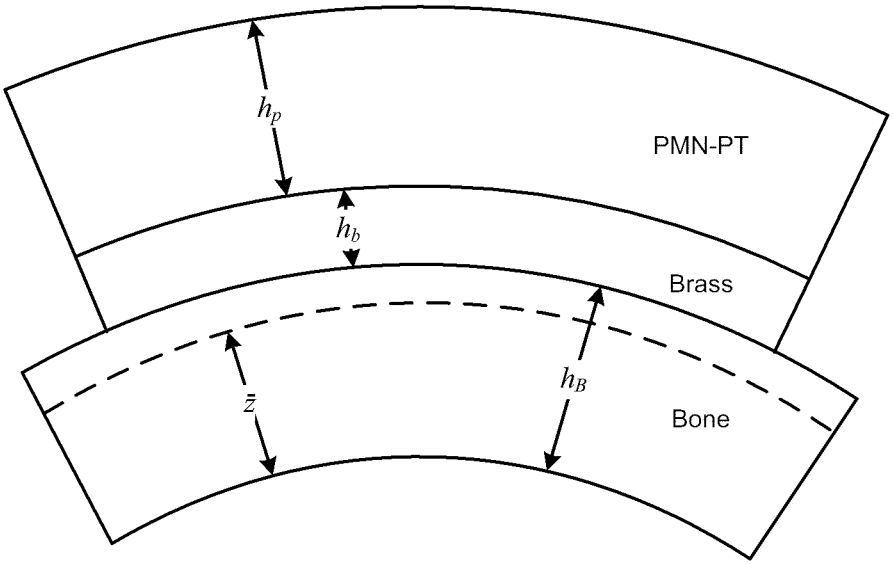

An analytical model for understanding the action of the present actuator is described below. The model assumes a unimorph piezoelectric disc bender. FIG. 4 shows the geometry of the unimorph bender 62 when bending. The dotted line shows the neutral plane at which the strain is zero. The unimorph bender 62 acts as a mechanical transformer, converting the high stress, low strain expansion of the piezoelectric material into a low-force, high-deflection bending motion of the whole structure. This allows a piezoelectric material to drive high-amplitude vibratory motion in materials with a bending stiffness much lower than the compressional stiffness of the piezoelectric.

For this analysis, the unimorph bender 62 is considered to be a single crystal 0.70Pb $(Mg_{1/3}Nb_{2/3})O_3$0.30$PbTiO_3$ (PMN-PT) (TRS Technologies, State College, Pa.) layer bonded to a 25.4 μm thick brass shim with a <1 μm thick layer of epoxy. PMN-PT is a relatively new piezoelectric material capable of generating strains ten times greater than more traditional materials like lead zirconate titanate (PZT). PMN-PT single crystal has enormous potential for actuating implanted hearing devices, and has recently been studied as a potential material for middle ear implants. The use of PMN-PT is merely for the purposes of illustration, and should not be considered limiting.

There are many models for understanding piezoelectric bending actuators in various geometries. The following discussion models the actuator as a circular piezoelectric unimorph, which has a single piezoelectric layer bonded onto a non-piezoelectric layer. Bimorphs with two piezoelectric layers are also quite common, as are multilayered actuators. A useful analysis of the circular piezoelectric unimorph was carried out by Dong et al. (see e.g. S. Dong, K. Uchino, L. Li, and D. Viehland, "Analytical solutions for the transverse deflection of a piezoelectric circular axisymmetric unimorph acuator", IEEE Tranactions on Ultrasonics, Ferroelectrics, and Frequency Control 54, 1240-1249 (2007)) whose approach we follow here. Other models also exist for rectangular bending beam actuators, but are somewhat more complicated due to the lower symmetry. The following illustrative analysis of the circular disk actuator provides a general understanding of its behaviour, but other geometries such as the rectangular bender should be qualitatively similar.

Figure 5:
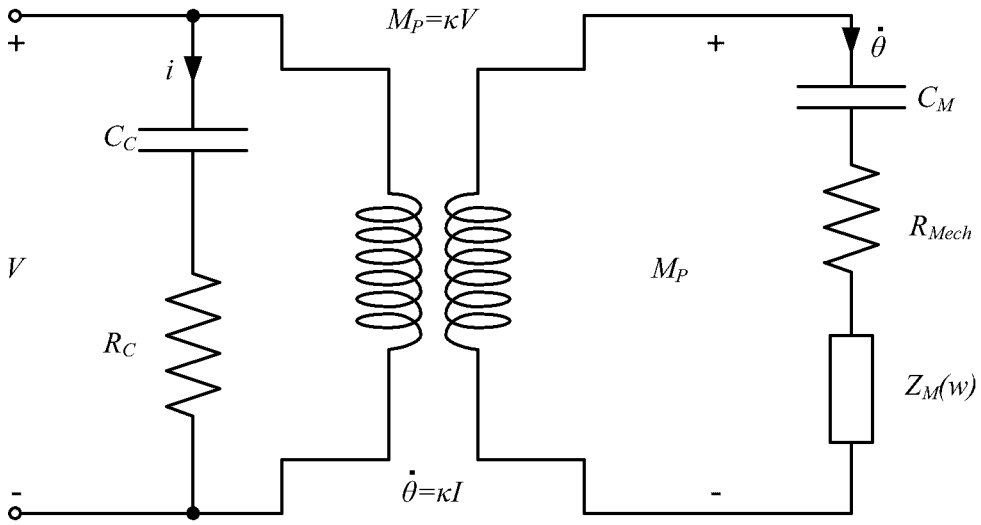
FIG. 5 is an equivalent circuit model of a unimorph piezoelectric actuator according to the present invention.

The equivalent circuit model of the actuator as seen from the driving electronics is shown in FIG. 5. The circuit model shown in FIG. 5 includes a surface-charging circuit on the left and a mechanical circuit on the right with a transformer between them representing the electromechanical conversion. The application of a voltage to the actuator acts both to cause bending and to create a surface charge on the device. Electrically, these two processes will both appear as capacitive loads to the driving electronics. The mechanical capacitance $C_M$ due to bending of the actuator can be separated from that due to surface charging, the clamped capacitance $C_c$. Losses in charging $C_c$ can be modeled as a resistance $R_c$ (i.e. $C_c$ and $R_c$ are the capacitance and charging resistance related to the surface charge on the piezoelectric layer). The transformer represents the conversion of electrical quantities into mechanical quantities through the piezoelectric effect. Voltage is transformed into bending moment and current into angular velocity through the electromechanical coupling constant κ. The electromechanical coupling constant κ also relates the current flowing into and out of the piezoelectric layer with its motion $\dot{\theta}$. On the other side of the transformer the flexural rigidity of the actuator is represented by a capacitor $C_M$ since the bending moment is in phase with the bending angle. The mechanical losses are represented by $R_{mech}$, and the effect of the rest of the skull is represented an equivalent bending impedance $Z_M(w)$. In this circuit model the bending impedance $Z_M(w)$ appears in series with the impedance due to the actuator's flexural rigidity, shown as a capacitance.

As noted above, bending beam actuators work by having a piezoelectric layer create a lateral strain in the plane of the surface. A second layer, that can either be passive (as for unimorphs) or piezoelectric (as for bimorph benders), prevents straining at the bottom layer of the piezoelectric. The mismatched strains on the two surfaces of the piezoelectric create a bending moment in the whole structure. The lateral strain generated by a piezoelectric material is characterized by the piezoelectric constant $d_{31}$. For the material used in this study $d_{31}=-1000$pC/N. A free plate of piezoelectric material will experience a strain $\delta_{11}=d_{31}E_3$ where $E_3=V/h_p$ is the transverse electric field strength across a piezoelectric plate of thickness $h_p$ and with an applied voltage of V. More generally, the strain in a piezoelectric material is given by the piezoelectric constitutive equation $$\delta_{11}=s_{11}^{E}\sigma_{11}+d_{31}E_s \tag{1}$$

where $s_{11}^{E}$ is the material compliance measured under constant field and $\sigma_{11}$ is the lateral component of the stress. $s_{11}^{E}=69\times10^{-12}\text{Pa}^{-1}$ for PMN-PT.

When the unimorph structure shown in FIG. 4 bends, the top part is in extension and the lower part in compression. In between there exists a neutral plane that experiences zero strain. In a composite structure like the piezo-brass-bone unimorph, the location of the neutral plane depends on the thickness and Young's modulus of each material in the composite. The lateral strain of all layers in the structure then varies linearly with the distance from the neutral plane.

Tests were performed with two devices, both piezoelectric unimorph benders, one a circular disk of radius 5 mm and thickness 150 μm and the other a rectangular beam of length 30 mm, width 10 mm and thickness 250 μm. Both devices were made from single crystal PMN-PT bonded onto a 25.4 μm thick brass shim with a <1 μm thick layer of epoxy. The piezoelectric material was poled so as to expand laterally when an electric field was applied between the two sides. While the top layer of the crystal was free to expand, the stiffness of the brass shim and bone beneath it inhibited lateral strain at the interfaces. The unequal strain through the thickness of each layer causes a bending moment throughout the composite structure.

Figure 6:
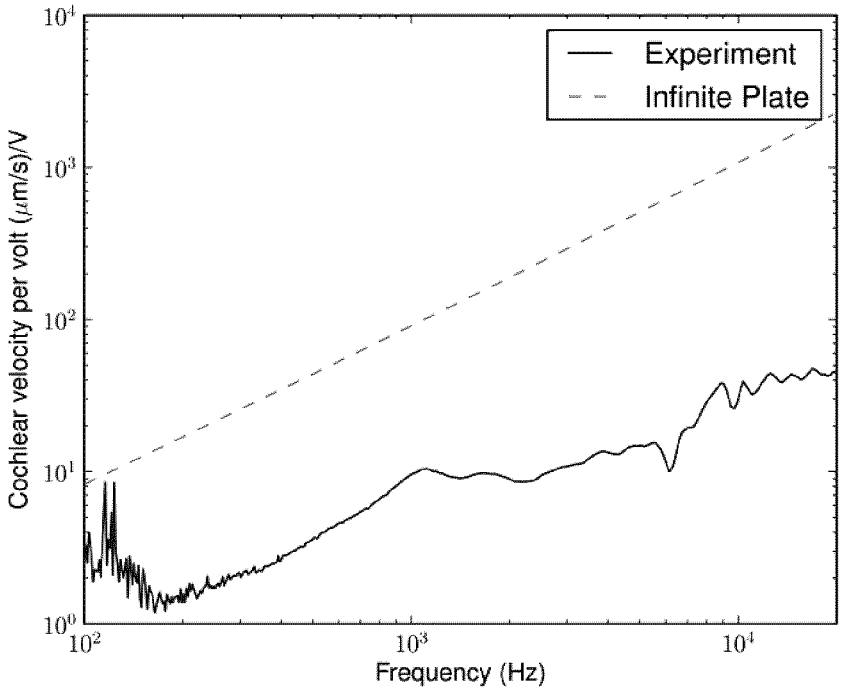
FIG. 6 is a comparison of the infinite plate model to measured values.

FIG. 6 shows a comparison between the predictions of a simplistic infinite plate model of the skull and measurements performed on one of the two heads with the round disk attached normalized to 1V. Considering the simplifications made in the model and the fact that measurements are being made on the cochlea rather than on the edge of the transducer, the results agree reasonably well. The model predicts velocities approximately an order of magnitude higher those measured, which is to be expected given that the cochlea is roughly 5 cm from the disk, ten times the disk radius and the amplitude will be expected to drop roughly as 1/r. Moreover, the model qualitatively captures the observed frequency dependence, with the slope agreeing particularly well at low frequencies. At high frequencies this quasistatic model, which ignores the inertia of the actuator, can be expected to break down. The model will only be valid for frequencies well below the first bending resonance of the unimorph structure. The first resonance of the disk can be calculated from the time-dependent partial differential equation for plate bending $$\nabla^2\nabla^2\omega+\frac{\rho h}{4D}\frac{\partial^2 w}{\partial t^2}=0 \tag{2}$$

Under conditions of symmetric loading, the first eigenfrequency of this differential equation occurs at $$f_{01}=1.015^2\frac{\pi}{a^2}\sqrt{\frac{D}{\sum_i h_i\rho_i}} \tag{3}$$

Inserting values appropriate for the test disks, we find a resonant frequency of 68 kHz, well outside the range of human hearing. Thus, ignoring inertial effects is justified at frequencies within the range of human hearing.

For acoustic frequencies, the impedance is dominated by the capacitances in the system. The total capacitances of the actuator disk and beam bonded to the skull were measured to be respectively 10±0.1 nF and 22±0.4 nF, although no measurements were made that were capable of separating this capacitance into mechanical and electrical parts. By implementing an electrical driver capable of recovering a large fraction of the energy stored in the actuator capacitance, very efficient driving of the mechanical load $Z_M$ is possible.

To investigate the effectiveness of the piezoelectric unimorph benders for bone conducted hearing actuators, a number of measurements were performed on two embalmed human heads, one male and one female, both aged 60-70 years at the time of death. The embalming procedure consisted of the injection of 40-60 l. of embalming fluid through the femoral artery, followed by another 20 l. of hyperdermic injection at various sites. The mass of the male head was 4234 g and the mass of the female head was 3730 g. Both heads had normal ears and mastoids, with no visible sign of disease or trauma.

Vibration measurements were performed with a Polytec CSV-3D (Polytec GmbH, Waldbronn Germany), 3D laser Doppler vibrometer, capable of measuring the magnitude and direction of vibration of a single point approximately 150 μm in diameter. To allow the laser to reach the cochlear promontory, the ear canal was widened to 2 cm diameter, and the tympanic membrane and ossicular chain were removed. A 1 $mm^2$ piece of retroreflecting tape was attached to the cochlear promontory with epoxy in order to increase the strength of the reflected signal.

In order to compare the present actuator with the BAHA, a BAHA inertial motor was removed from a BAHA Divino and a BAHA abutment was inserted 5.5 cm behind the ear in the mastoid using an Osscora drill (Cochlear Bone Anchored Solutions AB, Göteborg, Sweden). A 4 mm-deep pilot hole was drilled and countersunk, and the self-tapping abutment with fixture mount was screwed into the hole until it could withstand a torque of 40Ncm. This procedure tried to mimic the surgical technique used for inserting the BAHA.

The experimental setup for frequency response measurements consisted of a Tektronix AFG 3101 arbitrary function generator driving a Crown audio amplifier. Data acquisition for both the laser Doppler and electrical measurements was performed with a National Instruments PCI-4452 four-channel data acquisition card. The BAHA and the bender were both driven through a 180Ω resistor and the voltage across this resistor was measured to obtain the current through the devices. The entire setup was controlled using Labview (National Instruments, Austin Tex.). Since hearing aids are small, battery-operated devices, one of the most important factors in comparing hearing aid designs is the device power consumption needed to achieve a given hearing level.

In evaluating bone-conduction devices on cadavers, a quantity believed to be closely correlated to hearing level is the level of vibration of the cochlear promontory which can be measured using laser Doppler vibrometry. The goal of an efficient bone conduction device is to achieve large cochlear motions while consuming minimal electrical power. In order to quantify the efficiency with which the device excites cochlear vibration, we define the efficacy as the ratio of the magnitude of the measured velocity of the promontory to the electrical power drawn by the device.

Because the electrical impedance of any realistic vibration driver is a complex quantity, the electrical power consumption of the device is also complex, being defined as $$P=VI^* \tag{25}$$

where * denotes complex conjugation. The real part of the power is the amount of power lost from the driver to the system due both to the creation of vibratory motion propagating away from the driver and to mechanical and electrical losses. The imaginary part of the power, the reactive power, is power that is stored by the system in each half cycle, and can be recovered from the system in the other half. The magnitude of the power is called the apparent power. In principle, by choosing a driver with the right output characteristics, it is possible to recover all of the reactive power, so that an amplifier only needs to drive the real power, although in practice this can be rather difficult to achieve, particularly over a broad frequency band. The efficacy can be defined as either the ratio of cochlear velocity to real power which we call the ideal efficacy or to the apparent power which we call the apparent efficacy. The ideal efficacy represents the maximum achievable efficacy for the device. In practice it should be possible to achieve roughly 80% of the ideal efficacy.

The ratio of the real power to apparent power is called the power factor, and it ranges from 0 to 100%, with 100% indicating purely real power draw. Even if a given amplifier is not optimally coupled to a vibrator, it is possible to measure the phase of the power by monitoring the voltage and current across the device. From these measurements the power factor can be calculated as $$PF = \frac{\mathrm{Re}[VI^*]}{|VI^*|}.$$

The electrical impedance of the benders tested ranged between 700Ω and 84kΩ over 100 Hz to 20,000 KHz, much higher than that of the BAHA which was between 40Ω and 600Ω. In order to compare the two devices, the motion of the cochlear promontory had to be normalized to the electric power drawn. The power was measured by measuring the voltage on either side of the 180Ω resistor. Because the resistor was in series with the actuator, the current through the resistor and actuator was the same, $(V_1-V_2)/(180\Omega)$. The power was calculated from, P=VI*, the real power from Re[P] and the apparent power |P|. The ideal and apparent efficacies were calculated as $|\vec{\upsilon}|/\mathrm{Re}[P]$ and $|\vec{\upsilon}|/|P|$ where $\vec{\upsilon}$ was the measured cochlear velocity.

Figure 7:
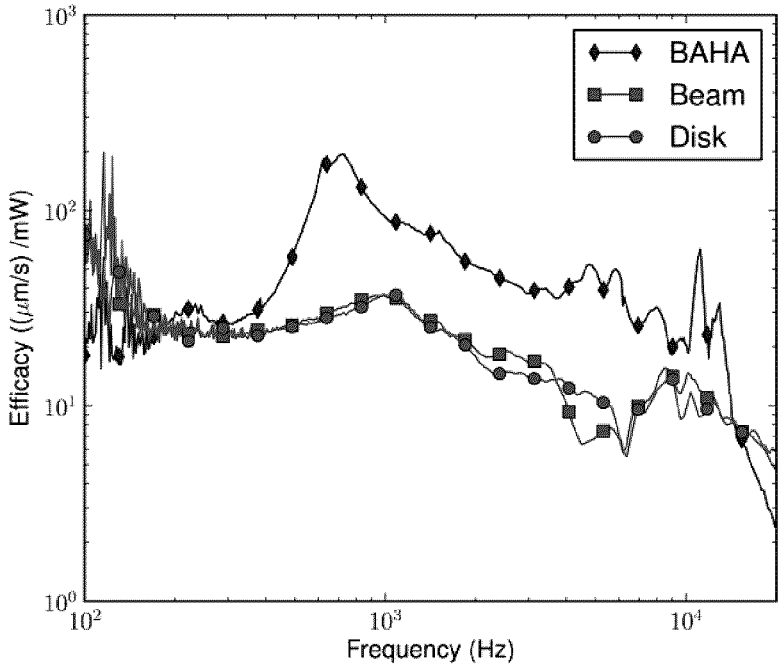
FIG. 7 is a comparison of the apparent efficacy between a BAHA device, and beam and disk benders according to the present invention.
Figure 8:
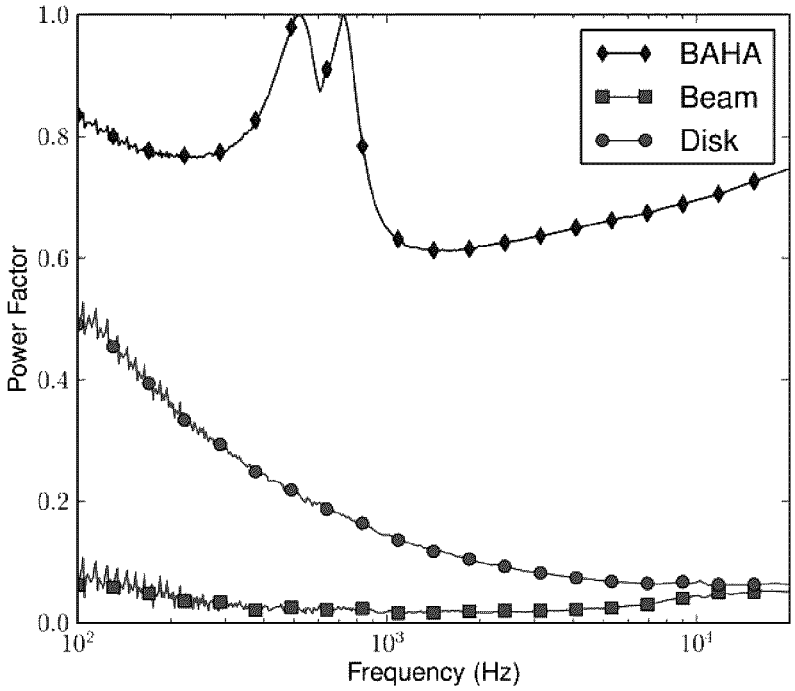
FIG. 8 is a comparison of the power factor between a BAHA device, and beam and disk benders according to the present invention.
Figure 9:
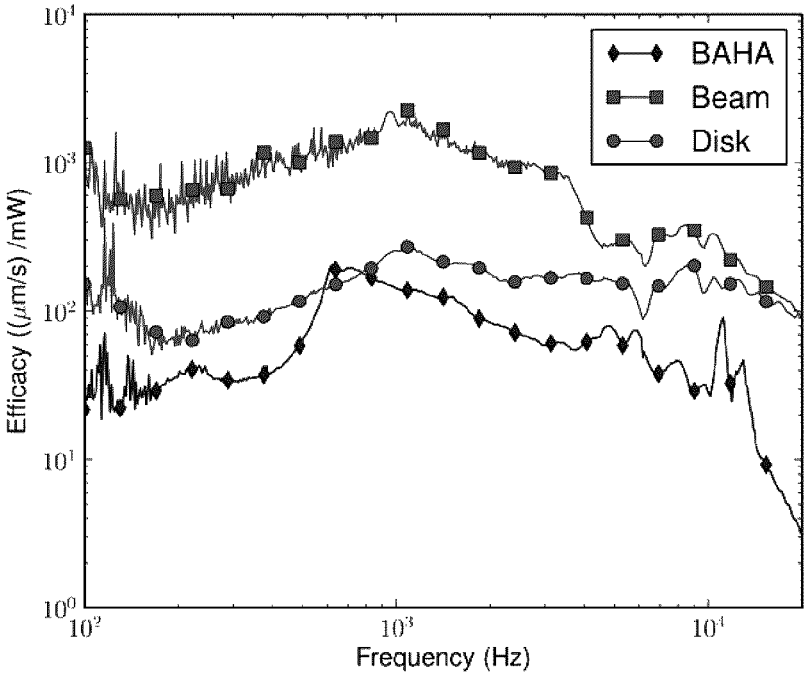
FIG. 9 is a comparison of the ideal efficacy between a BAHA device, and beam and disk benders according to the present invention.

FIGS. 7-10 compare the unimorph disk and beam benders to the BAHA device. FIG. 7, showing the cochlear promontory velocity normalized to the apparent electrical power draw, compares the present transducer and the BAHA efficacy and shows that for the same level of cochlear vibration the bender draws up to six times more apparent power than the BAHA. FIG. 8, shows the electrical power factor Re[P]/|P| of the two devices, and shows that the actuator behaves almost entirely capacitively, meaning that a properly impedance-matched driver should recover a high percentage of the driving power. FIG. 9 plots the ideal efficacy (cochlear promontory velocity normalized to the real power draw) and, by this measure, the bending actuator outperforms the BAHA by a factor of ten over nearly the entire frequency spectrum. FIG. 9 also shows that the larger piezoelectric beam is a more efficient vibrator than the smaller disk, particularly at low frequencies below 2000 Hz. This is most likely due to the lower flexural rigidity of the larger beam.

Figure 10:
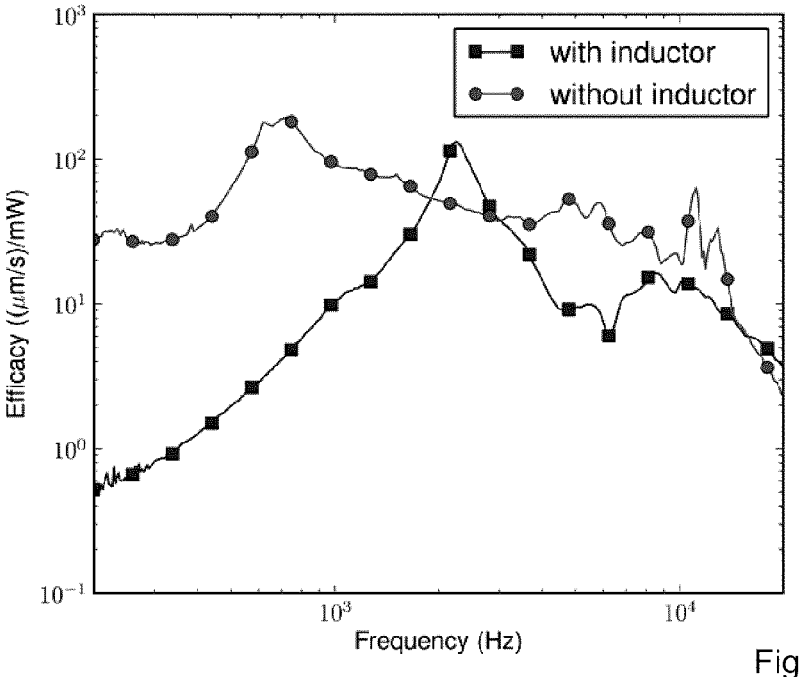
FIG. 10 is a comparison of the efficacy between a BAHA device and beam bender according to the present invention with a parallel inductor to cancel the reactive power at 2287 Hz.

To demonstrate that it is indeed possible to recover most of the apparent power, a 220 mH inductor was placed in parallel with the actuator so as to cancel the reactive part of its impedance at 2287 Hz. FIG. 10 shows the result: the bender is approximately three times more efficient than the BAHA at this frequency. Thus, with appropriate broadband impedance matching circuitry in a form-factor small enough to be useful in hearing actuators, the bender is a more efficient bone vibrator than the current leading solution.

Figure 11:
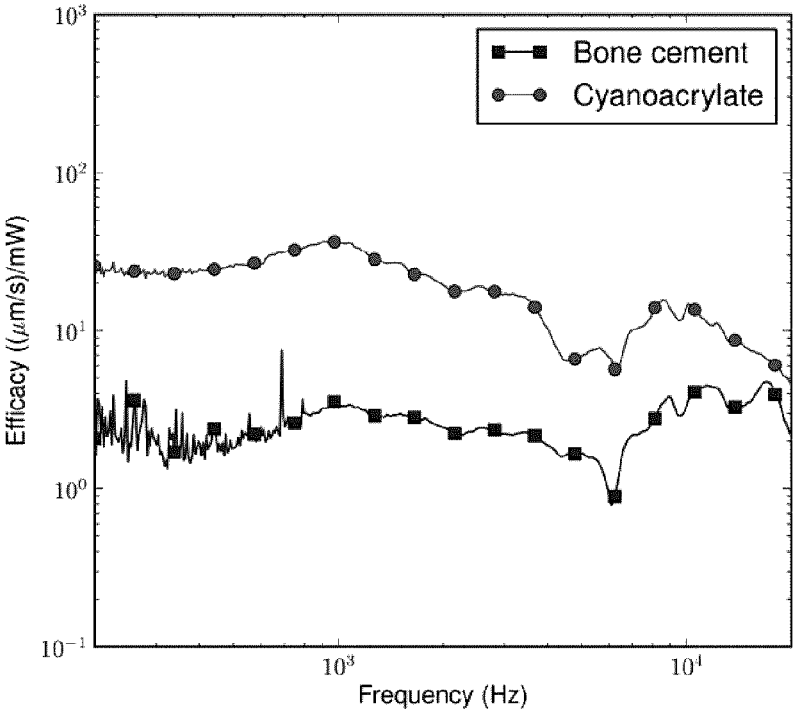
FIG. 11 is a comparison of the efficacy between a beam benders according to the present invention fixed to a skull with bone cement and a cyanoacrylate adhesive.

In attaching the actuator to the skull, a rigid coupling that effectively transfers the bending moment from the bender to the skull is preferred. For example, two adhesives commonly used in biomedical applications, cyanoacrylate and bone cement, can be used. For the present tests, cyanoacrylate was applied to the brass shim in a thin layer and pressed against the embalmed head's mastoid promontory for five minutes. It was allowed to set for two hours before measurements were taken. The bone cement created by mixing polymethylmetacrylate (PMMA) powder and liquid methyl metacrylate (MMA) in a 2 to 1 mixture. The wet compound was applied to the brass shim and pressed against the mastoid for five minutes. It was allowed to set for 2 hours before measurements were taken. FIG. 11 compares the efficacy achieved with different methods of attaching the bender to the embalmed skull. Cyanoacrylate appears to be a much better coupling material than bone cement for this application. This is believed to be because the cyanoacrylate layer is much thinner than the bone cement layer due to the 100 μm size of the cement particles. By contrast, the cyanoacrylate layer could be made thinner than 10 μm. A thick coupling layer between the actuator and the bone results in increased straining of the coupling layer and less straining of the bone. It should be noted that in implanting a live human, osseointegration could play a major role in strengthening the metal shim surface if the shim layer is either made of titanium or coated with titanium. Titanium screws can also be used to fix the bender to the skull, whether alone or in conjunction with an adhesive bonding agent.

The above-described embodiments of the present invention are intended to be examples only. Alterations, modifications and variations may be effected to the particular embodiments by those of skill in the art without departing from the scope of the invention, which is defined solely by the claims appended hereto.

The invention claimed:

1. A bone conduction hearing aid, comprising:

a piezoelectric transducer for subcutaneous fixation to a skull of a patient in the vicinity of the mastoid promontory, the piezoelectric transducer being laterally distorted in response to an applied electrical field thereby applying a compressional lateral stress and bending moment to bone of the skull in the vicinity the piezoelectric transducer and bending the bone to generate bone vibration to excite the movement of cochlear fluids; and driver circuitry to apply the electrical field to the piezoelectric transducer in response to sound waves detected by a microphone.

2. The hearing aid of claim 1, wherein the piezoelectric transducer is a piezoelectric bender configured to apply a localized bending moment to the skull.

3. The hearing aid of claim 2, wherein the piezoelectric bender is a disk bender or a beam bender.

4. The hearing aid of claim 3, wherein the piezoelectric transducer is a unimorph, bimorph or multilayered piezoelectric bender.

5. The hearing aid of claim 2, wherein the piezoelectric bender has a polyhedron shape and includes at least one piezoelectric layer.

6. The hearing aid of claim 1, wherein the piezoelectric transducer is configured for fixation to an outer surface of the skull.

7. The hearing aid of claim 6, wherein the fixation comprises bonding to a surface of the skull.

8. The hearing aid of claim 7, wherein the bonding comprises a biocompatible adhesive.

9. The hearing aid of claim 8, wherein the biocompatible adhesive is a bone cement or a cyanoacrylate adhesive.

10. The hearing aid of claim 6, wherein the subcutaneous fixation comprises fasteners for attaching the piezoelectric transducer to the skull.

11. The hearing aid of claim 10, wherein the fasteners comprise titanium screws.

12. The hearing aid of claim 1, wherein the piezoelectric transducer is configured for fixation in a slot formed in the skull.

13. The hearing aid of claim 12, wherein the piezoelectric transducer is a stack or tube piezoelectric transducer.

14. The hearing aid of claim 1, wherein the piezoelectric transducer includes means to promote osseointegration.

15. The hearing aid of claim 1, wherein the driver circuitry comprises an inductive link.

16. The hearing aid of claim 15, wherein the inductive link comprises a transmitter coil for external placement and transcutaneous excitation of a complementary implanted receiver coil connected to the piezoelectric transducer.

17. The hearing aid of claim 1, wherein the driver circuitry is self-contained and configured for subcutaneous implantation.

18. An actuator for a bone conduction hearing aid system, comprising at least one piezoelectric transducer for subcutaneous fixation to a skull of a patient in the vicinity of the mastoid promontory, the piezoelectric transducer being laterally distorted in response to an applied electrical field thereby applying a compressional lateral stress and a bending moment to bone of the skull in the vicinity the piezoelectric transducer and bending the bone to generate bone vibration to excite the movement of cochlear fluids.

19. The actuator of claim 18, wherein the piezoelectric transducer is a disk bender or a beam bender.

20. The actuator of claim 19, wherein the piezoelectric transducer is a unimorph, bimorph or multilayered bending piezoelectric transducer.

21. The hearing aid of claim 18, wherein the piezoelectric transducer has a polyhedron shape.

22. The actuator of claim 18, wherein the piezoelectric transducer includes means to promote osseointegration.

* * * * *